United States Patent [19]

Hausladen

[11] 4,025,095

[45] May 24, 1977

[54] LATCH APPARATUS

[75] Inventor: Joe Hausladen, Santa Rosa, Calif.

[73] Assignee: Lawrence Peska Associates, Inc., New York, N.Y.

[22] Filed: Aug. 3, 1976

[21] Appl. No.: 711,311

[52] U.S. Cl. ..... 292/108; 292/210; 292/285

[51] Int. Cl.[2] ..... E05C 19/12

[58] Field of Search ..... 292/108, 210, 341.17, 292/285

[56] References Cited

UNITED STATES PATENTS

| | | | |
|---|---|---|---|
| 404,161 | 5/1889 | Brown | 292/108 |
| 489,326 | 1/1893 | Pugh | 292/285 |
| 929,612 | 7/1909 | Luschka | 292/341.17 |
| 3,738,133 | 6/1973 | Newlon | 292/210 |

*Primary Examiner*—Paul R. Gilliam
*Assistant Examiner*—Kenneth J. Dorner

[57] ABSTRACT

Latch apparatus is disclosed for use in combination with a hinged door and a stationary member and comprises first and second cooperating members adapted to be mounted to the door and the stationary member, the first member adapted to be mounted to one of the said door and stationary members and the second member adapted to be mounted to the other of said door and stationary members. The first member comprises a pivotally mounted pin engaging member having a slot opening therein for engaging a pin and an arm pivotally mounted on the pin engaging member for swinging over the slot opening. The second member comprises a knob having a detent in the outer periphery thereof for receiving the end of the arm when the arm is positioned over the opening in the pin engaging member. Apparatus is also provided to prevent the movement of the latch apparatus in a direction towards the longitudinal axis of the pivot on which the pin engaging member is mounted when the arm is positioned over the opening in the pin engaging member and received by the detent in the knob.

5 Claims, 3 Drawing Figures

LATCH APPARATUS

SUMMARY OF THE INVENTION

The present invention relates to latch apparatus for use in combination with a hinged door and a stationary member, first and second cooperating assemblies being provided and adapted to be mounted to the door and the stationary member, the first assembly adapted to be mounted to one of the door and stationary member and comprising a pivotally mounted pin engaging member mounted on a first pivot the pin engaging member having a recessed section therein extending inwardly from an opening, an arm being provided which is pivotally mounted on the pin engaging member through a second pivot. The arm is adapted to swing over the opening in the pin engaging member, the arm extending beyond the opening for engagement by said second assembly. The second assembly is adapted to be mounted to the other of said door and stationary member and comprises a pin member adapted to be received by said recessed section in said pin engaging member, the second assembly further comprising a knob for rotatably mounting on the other of said door and stationary member, a detent extending inwardly from an opening in the periphery of said knob for engaging the end of said arm. The knob further has a torque loadable resilient member operatively connected thereto for applying a return torque to the knob when it is rotated from a position engaging and holding the arm over the opening to a position for releasing the arm to pivot away from the opening. Additionally, retaining apparatus operatively engages the first assembly for preventing the movement of the latch apparatus in the direction of the longitudinal axis of the first pivot when the arm is swung over the opening and is engaged by the detent in the knob.

The pin engaging member may comprise a plate, the opening in the pin engaging member being on an edge of the plate which is positioned away from the first pivot.

The retaining member may comprise a flange projecting over the side wall of the knob for covering the side area of the detent, or a flange extending from the end of the pin for projecting over an area of the plate adjacent the opening or both, the aforementioned flange projecting over the side wall of the knob and the aforementioned flange extending from the end of the pin.

DETAILED DESCRIPTION

Latch apparatus for doors and/or gates is disclosed in the prior art U.S. Pat. Nos. 3,655,288 Coopersmith, et al.; 2,742,722 Schaeffer; 2,599,211 Tilbury; 1,038,111 Foss; 207,120 Hunt and, 3,239,261 Bryson, et al.

It is an object of the present invention to provide novel latch apparatus for gates, door and the like which is not easily opened by young children. It is also an object of the present invention to provide such a latch apparatus which is also not readily opened by dogs or other domestic animals and farm animals, many of which are adept at operating the mechanism of simpler latches known in the prior art.

It is therefore an object of the present invention to overcome these and other difficulties encountered in the prior art.

It is a further object of the present invention to provide a novel latch apparatus which is not readily opened. It is also an object of the present invention to provide latch apparatus which has to be operated by both hands in order to obviate some of the difficulties encountered in the prior art, gate or door latches which are of simple construction and readily opened by younger children and domestic and farm animals.

These and other objects have been achieved according to the present invention and will become apparent by reference to the disclosure and claims that follow as well as the appended drawing.

Figure 1:
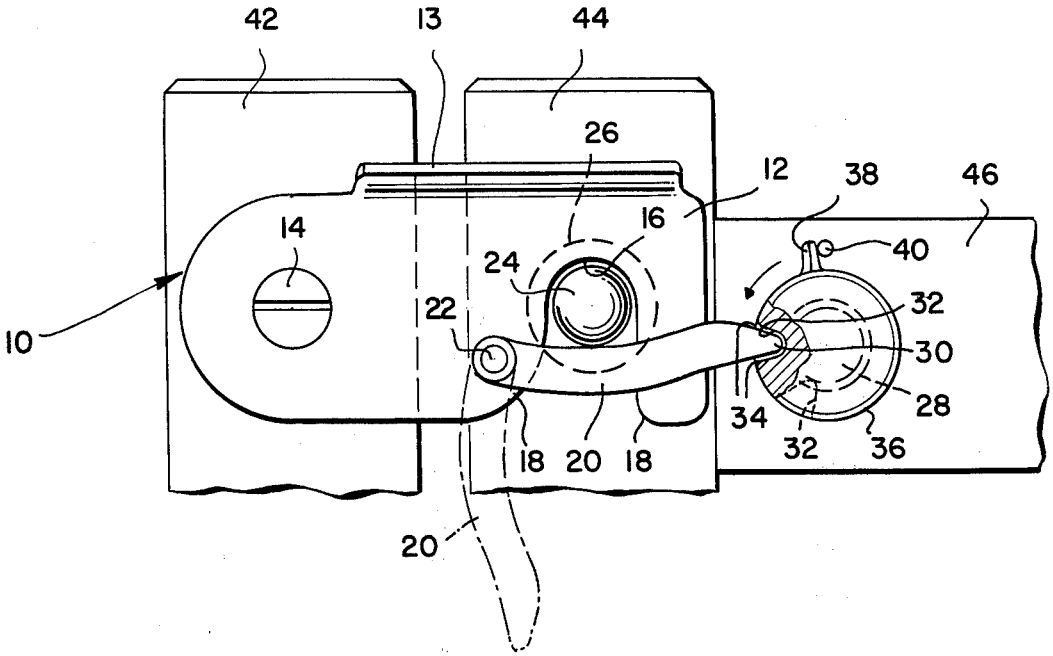
FIG. 1 comprises a side elevation partially in section illustrating a latch apparatus having a pin engaging member, an opening in the pin engaging member to swing over the opening and to engage a detent position in the peripheral surface of a rotatable knob according to one embodiment of the present invention.
Figure 2:
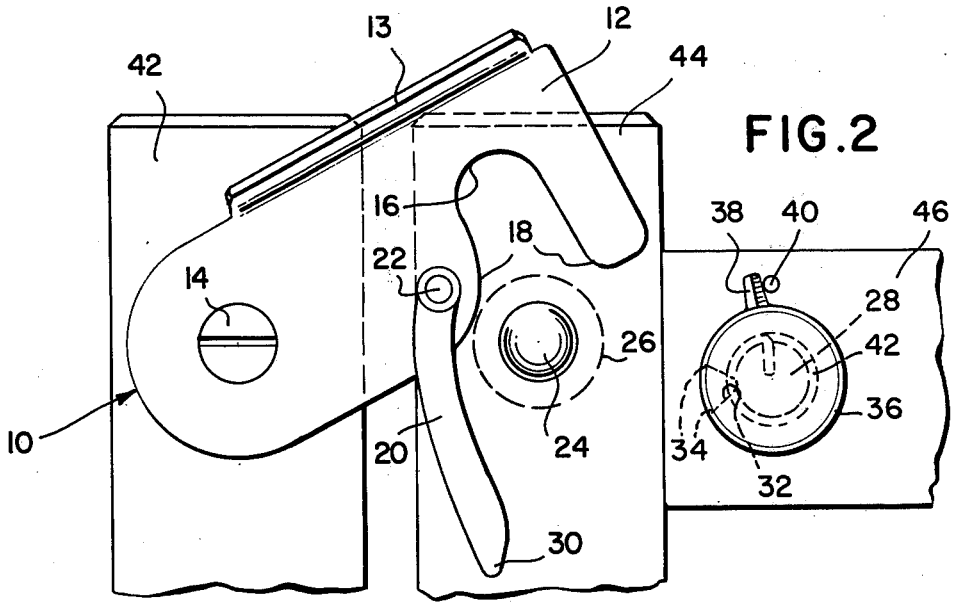
FIG. 2 comprises a side elevation partially in section of substantially the same apparatus as illustrated in FIG. 1 and illustrating the pin engaging member in a position where it is pivotally disengaged from a pin according to yet another embodiment of the present invention.
Figure 3:
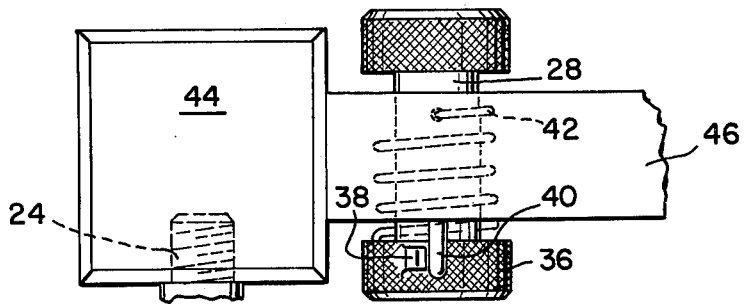
FIG. 3 comprises a plan view in section of the apparatus substantially as described previously with respect to FIG. 1.

Referring to the drawing, and FIGS. 1–3, latch apparatus 10 is disclosed comprising a pin engaging member 12 mounted on a first pivot 14, the pin engaging member 12 comprising a flat plate in one embodiment, pin engaging member 12 having a flange 13 thereon for grasping. A recessed section 16 extends inwardly from an opening 18 in the pin engaging member 12, the opening 18 being on an edge of the plate 12 which is positioned away from the pivot 14. An arm 20 (shown in the phantom configuration and solid configuration in FIG. 1) is pivotally mounted on the pin engaging member 12 through a second pivot 22, the arm 20 being adapted to swing over the opening 18 and extend beyond the opening 18 for engagement by a knob 28. The pin engaging member 12 and the appurtenant members operatively connected thereto comprises a first assembly of the latch apparatus for use in combination with a hinged door and a stationary member, the first assembly of the latch apparatus also cooperating with a second assembly, both the first and the second assemblies being adapted to be mounted to a door such as stud 44 and arm 46 and a stationary member such as a gate post 42, the first assembly being adapted to be mounted to one of the said doors and stationary members. The second assembly adapted to be mounted to the other of the said door and stationary member, comprises a pin 24 adapted to be received by the recessed section 16 in the pin engaging member 12. Optionally, pin 24 has a flange 26 shown in phantom configuration, for projecting over an area of the pin engaging member 12 adjacent the opening 18 and the recess 16 as illustrated in FIG. 1. The second assembly also comprises a knob 28 for rotatable mounting on the other of said stationary member and door or gate member, a detent 32 extending inwardly from an opening 34 in the periphery of knob 28 for engaging the end 30 of arm 20. A torque loadable resilient member such as a coil spring 42 is operatively connected to knob 28 for applying a return torque to the knob when it is rotated from a position engaging and holding the end 30 of arm 20 in detent 32 to a position for releasing arm 20 to pivot away from opening 18 as illustrated in FIG. 2 and as illustrated by phantom configuration 20 of FIG. 1. A retaining member may also be provided on knob 28 and comprises a flange 36 projecting over the side wall of knob 28 for covering the side area of detent 32. A boss 38 extends from the periphery of knob 28 to engage stop 40 so that the opening 34 and the detent 32 will be positioned to hold the end 30 of arm 20 in a locking position as illustrated in FIG. 1, this position of opening 34 and detent 32 being maintained by torsion spring 42 which also resiliently biases boss 38 into engagement with stop 40. At least one of the flanges 26 or 36 is employed to operatively engage the first assembly for preventing the movement of the latch in the direction of the longitudinal axis of the first pivot 14 when the arm 20 is swung over the opening 18 and the end 30 thereof is engaged by the detent 32 of knob 28.

In use, the plate 12 may be installed either on a post 42 or a door member such as a stud 44 and arm 46. The other assembly of the latch apparatus comprising pin 12 and knob 28 will be mounted on the other of the stationary member such as post 42 or the door or gate comprising gate post 44 and gate arm 46. As illustrated in FIGS. 1–3, the first assembly comprising plate 12 is secured to a gate post 42 and the second assembly comprising pin 24 and knob 28 are mounted on stud 44 comprising a gate arm 46. When positioned as illustrated the plate 12 is swung downwardly so that the opening 18 and the recess area 16 extending therefrom engage the pin 24 after which the arm 20 is swung upwardly while the knob 28 is rotated applying return torque to spring 42, so that the detent 32 extending from the opening 34 thereof engage the end 30 of arm 20. As arm 20 is moved along with knob 28 in this manner, the return torque applied to torsion spring 42 biases knob 28 so that boss 38 abuts pin 40 thereby holding arm 20 in a position so that the opening is covered. The plate 12 cannot be moved in the direction of the axis of pivot 14 since the first and second assemblies of the latch apparatus are held in place either by the flange 36 on knob 28 and/or the flange 26 on pin 24. When the latch is to be opened, knob 28 is rotated in a downward direction with respect to the illustrations of FIGS. 1, 2 and 3 and a return torque is applied to the tension spring 42 by such rotation. The arm 20 pivots downwardly and falls clear of pin 24 as illustrated in FIG. 2. Upon moving plate 12 in an upward direction, the gate comprising stud 44 and arm 46 may be moved away from the gate post 42. When flange 26 is employed on pin 24, the gate cannot be opened until the plate 12 is moved in an upward direction as illustrated in FIG. 2.

Although the invention has been described with reference to some embodiments, it is not intended that the novel latch apparatus be limited thereby but that modifications thereof are intended to be included as falling within the broad spirit and scope of the foregoing disclosure, the following claims and the appended drawing.

What is claimed is:

1. Latch apparatus for use in combination with a hinged door and a stationary member, comprising first and second cooperating assemblies adapted to be mounted to the door and the stationary member, said first assembly adapted to be mounted to one of said door and stationary members and comprising a pivotally mounted pin engaging member mounted on a first pivot, said pin engaging member having an opening in an edge thereof and a recessed section therein extending inwardly from said opening, an arm pivotally mounted on said pin engaging member through a second pivot and adapted to swing over said opening in said pin engaging member, said arm extending beyond said opening for engagement by said second assembly, said second assembly adapted to be mounted to the other of said door and stationary member and comprising a pin member adapted to be received by said recessed section in said pin engaging member, said second assembly also comprising a knob for rotatably mounting on the other of said door and stationary members, a detent extending inwardly from an opening in the periphery of said knob for engaging the end of said arm when said recessed section engages said pin member, a torque loadable resilient member operatively connected to said knob for applying a return torque to said knob when it is rotated from a position engaging and holding said arm over said opening to a position for releasing said arm by pivoting away from said opening, retaining means on said second assembly operatively engaging said first assembly for preventing the movement of said latch in the direction of the longitudinal axis of said first pivot when said arm is swung over said opening and is engaged by said detent in said knob.

2. The latch apparatus of claim 1 where said pin engaging member comprises a plate, said opening being positioned away from said first pivot.

3. The latch apparatus of claim 2 where said retaining means comprises a flange projecting over the detent for covering the side of said detent.

4. The latch apparatus of claim 2 where said retaining means comprises a flange extending from the end of said pin for projecting over an area of said plate adjacent said opening.

5. The latch apparatus of claim 2 where said retaining means comprises a flange projecting over the detent for covering the side area of said detent and a flange extending from the end of said pin for projecting over an area of said plate adjacent said opening.

* * * * *